US012232585B2

(12) United States Patent
Zucco

(10) Patent No.: US 12,232,585 B2
(45) Date of Patent: Feb. 25, 2025

(54) POCKET COVER

(71) Applicant: Upper Echelon Products LLC, Austin, TX (US)

(72) Inventor: Michael Joseph Zucco, Austin, TX (US)

(73) Assignee: Upper Echelon Products LLC, Austin, TX (US)

( * ) Notice: Subject to any disclaimer, the term of this patent is extended or adjusted under 35 U.S.C. 154(b) by 30 days.

(21) Appl. No.: 18/159,198

(22) Filed: Jan. 25, 2023

(65) Prior Publication Data

US 2023/0232952 A1 Jul. 27, 2023

Related U.S. Application Data

(60) Provisional application No. 63/267,193, filed on Jan. 26, 2022.

(51) Int. Cl.
*A45C 13/00* (2006.01)
*A45C 13/10* (2006.01)

(52) U.S. Cl.
CPC ..... *A45C 13/002* (2013.01); *A45C 13/103* (2013.01)

(58) Field of Classification Search
CPC ..... A45C 13/002; A45C 13/103; A45C 13/02; A45F 3/04
See application file for complete search history.

(56) References Cited

U.S. PATENT DOCUMENTS 5,439,153 A * 8/1995 Murdoch ..... A45C 13/002 150/159
5,890,809 A * 4/1999 Nelson ..... A45F 3/00 224/664
5,988,879 A * 11/1999 Bredderman ..... B65D 81/3888 383/110
9,119,448 B1 * 9/2015 Hirshberg ..... A45C 7/0086
9,427,058 B2 * 8/2016 Boglione ..... A45C 5/03
2002/0113102 A1 * 8/2002 Klamm ..... A45C 7/0077 383/4
2003/0042091 A1 * 3/2003 Oh ..... A45C 5/06 190/102
2003/0230368 A1 * 12/2003 Cazes ..... A45C 1/024 150/113
2005/0077135 A1 * 4/2005 Drew ..... A45C 13/00 190/110
2005/0133399 A1 * 6/2005 Fidrych ..... A45F 3/04 206/545
2006/0196745 A1 * 9/2006 Siwak ..... A45C 15/00 190/110
2007/0017764 A1 * 1/2007 Cheng ..... A45C 13/002 190/100
2008/0061099 A1 * 3/2008 Tilby ..... A45C 11/00 224/675

(Continued)

*Primary Examiner* — Don M Anderson
*Assistant Examiner* — Justin Caudill
(74) *Attorney, Agent, or Firm* — DeLizio, Peacock, Lewin & Guerra LLP

(57) ABSTRACT

A container comprises a first pocket to store at least one item and a second pocket having an outer sidewall that is an inner sidewall of the first pocket. The container also comprises a pocket cover stowable in the second pocket while not used for covering the at least one item stored in the first pocket, wherein the pocket cover is configured to be removed from the second pocket and to cover the first pocket and the at least one item stored in the first pocket.

20 Claims, 11 Drawing Sheets

(56) References Cited

U.S. PATENT DOCUMENTS

| | | | | |
|---|---|---|---|---|
| 2012/0121210 | A1* | 5/2012 | Meyer | A45C 13/002<br>224/257 |
| 2015/0020936 | A1* | 1/2015 | Donaldson | A45C 7/0059<br>150/110 |

* cited by examiner

POCKET COVER

BACKGROUND

Embodiments of the inventive subject matter generally relate to the field of storage and containers, and, more particularly, to pocket covers.

Containers, particularly containers designed to store and permit carrying of items (e.g., backpacks), come in many different configurations. Many containers, such as backpacks, have various pockets in the interior of the container and around the outside, which are useful for organizing and stowing smaller items.

These pockets may come in different configurations. For example, some pockets may always be open while others may be sealable using various mechanisms, such as zippers and hook-and-loop fasteners. While open pockets typically offer more convenience, they are more exposed and more likely to lose their contents. In particular, pockets on the outside of a container may be visible to the public, so a means for covering or hiding the contents of a pocket may be useful.

BRIEF DESCRIPTION OF THE DRAWINGS

Embodiments of the disclosure may be better understood by referencing the accompanying drawings.

DESCRIPTION

The description that follows includes examples that embody the inventive subject matter described herein. However, it is understood that actual implementations of the inventive subject matter may vary from these examples. For example, pockets which are described as comprising a mesh component may use a cloth component instead, pockets which are described as using a zipper may use a hook-and-loop fastener, elastic closures may be replaced by drawstrings, etc. In other instances, well-known details and variations have not been shown in detail in order not to obfuscate the description.

When a container, e.g., a backpack, contains an open, external pocket, the contents of the pocket may be visible to the public and or insecure. There may be situations, however, in which a user would prefer that the contents of the pocket not be visible or be secured. A container may provide a pocket cover that permits the contents of the pocket to be hidden and/or secured.

Figure 1:
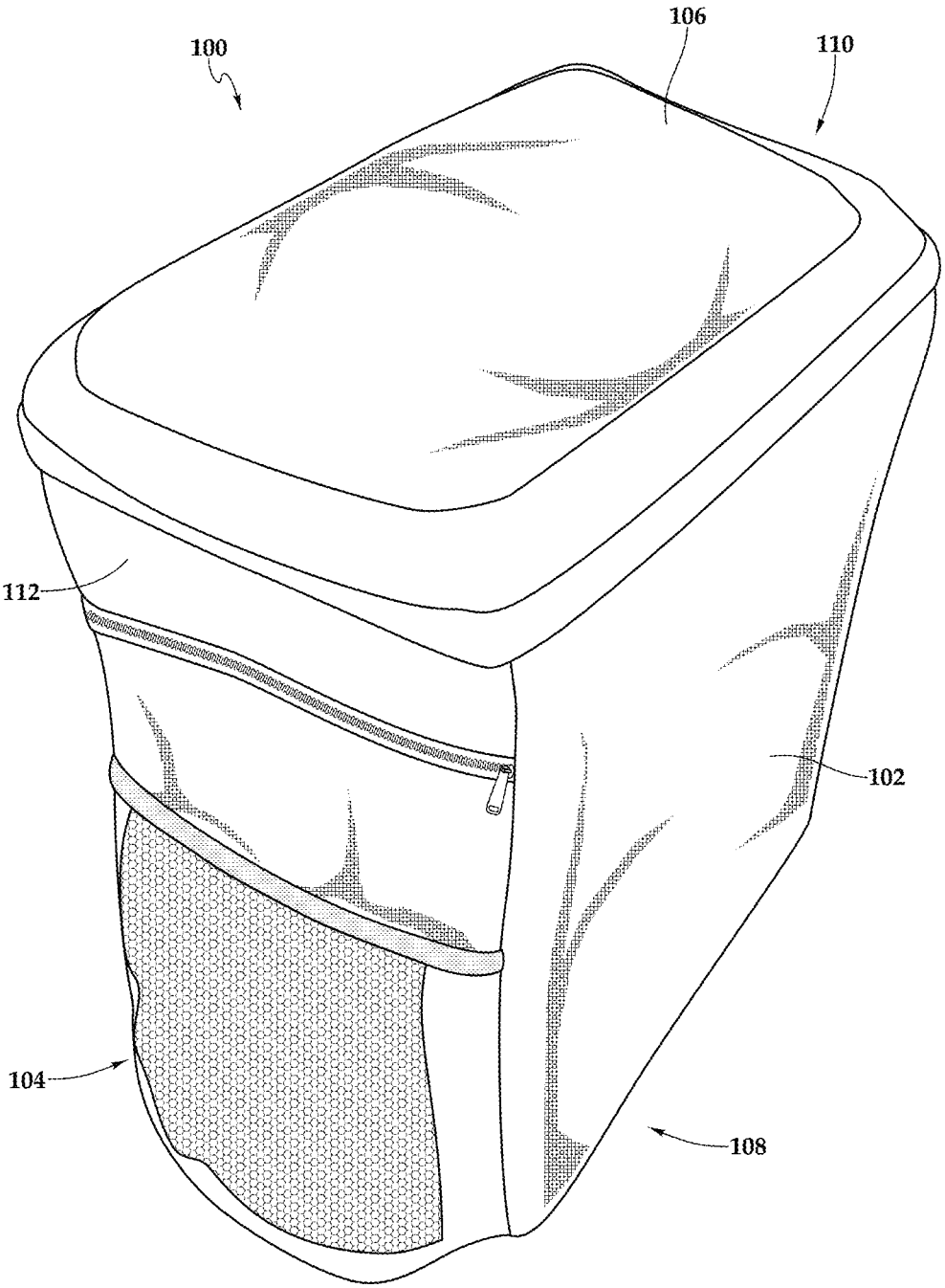
FIGS. 1-2 depict an example backpack having a pocket cover, according to some embodiments.
Figure 2:
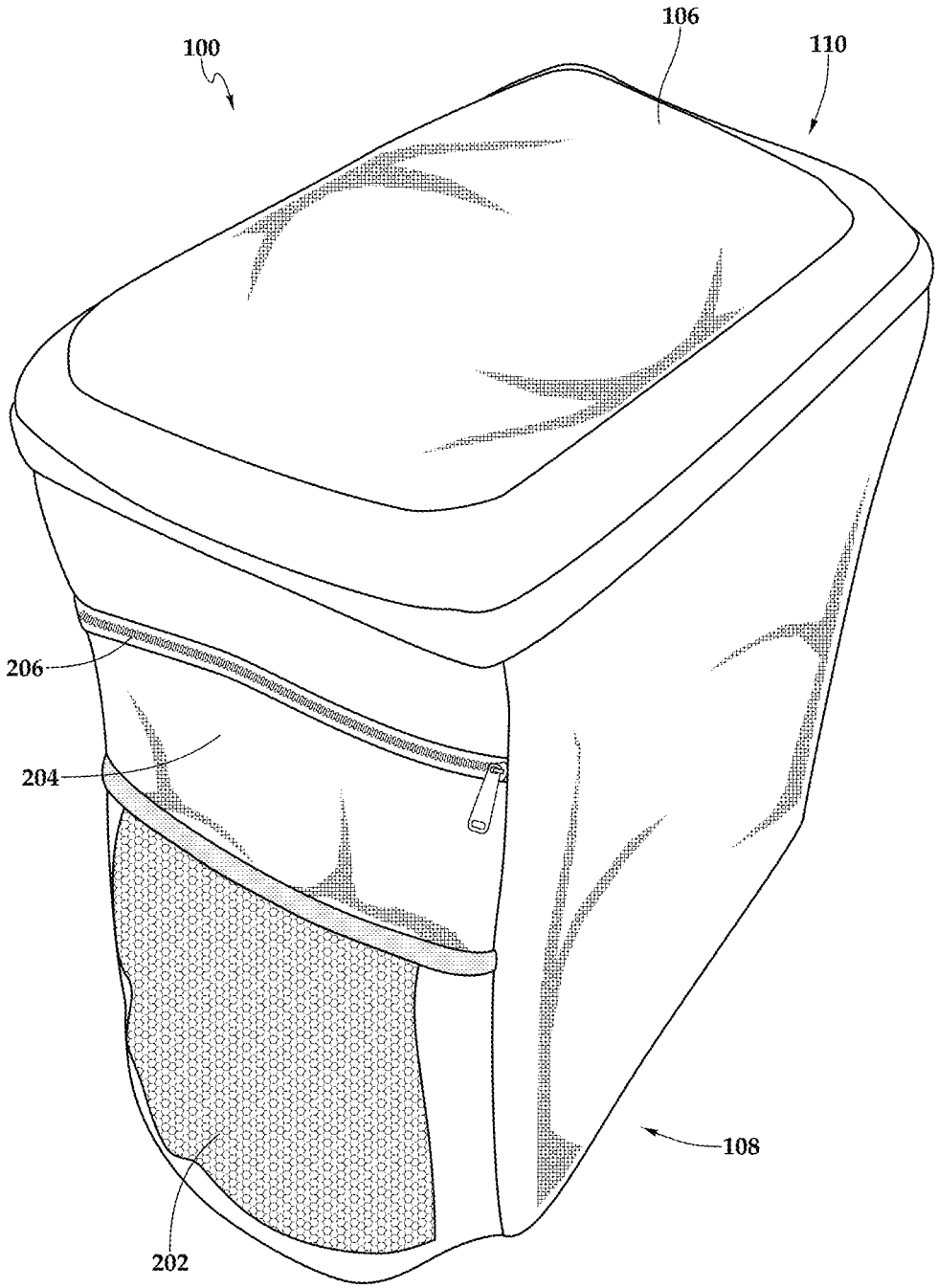

FIGS. 1-2 depict an example backpack having a pocket cover, according to some embodiments. FIGS. 1-2 depict a backpack 100 with a front 102, a back 104, a top 106, a bottom 108, a right side 110, and a left side 112. The backpack 100 further includes a first pocket 202, a second pocket 204, and a closed zipper closure 206 that closes the second pocket 204.

The first pocket 202 is comprised of at least an outer sidewall of cloth, mesh, or similar material and an inner sidewall of cloth, mesh, or similar material. The second pocket 204 is comprised of at least the inner sidewall of the first pocket 202, which serves as the outer sidewall of the second pocket 204, and an additional inner sidewall of cloth, mesh, or similar material. The inner sidewall of the first pocket 202 may serve as the exterior of the backpack 100 and the inner sidewall of the second pocket 204 may service as the interior of the backpack 100.

Figure 3:
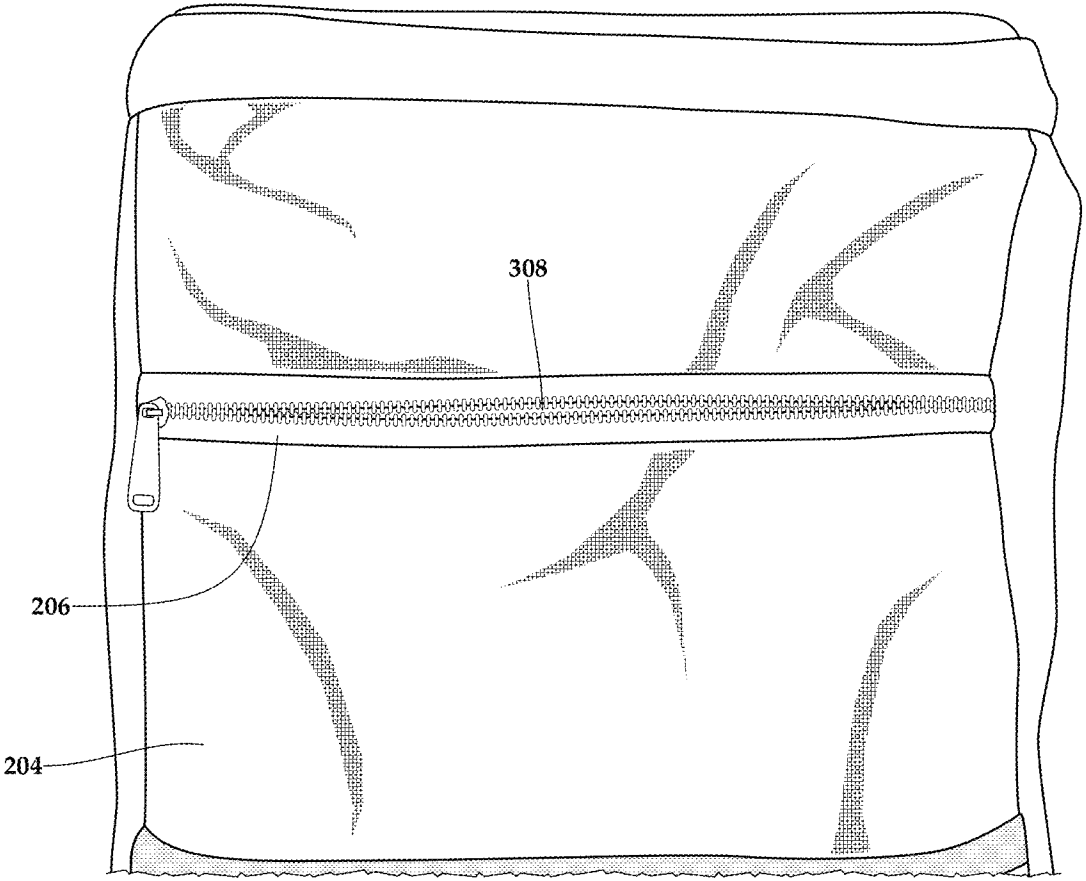
FIG. 3 depicts an example external second pocket in which a pocket cover may be stored for the example backpack of FIGS. 1-2, according to some embodiments.

FIG. 3 depicts an example external second pocket in which a pocket cover may be stored for the example backpack of FIGS. 1-2, according to some embodiments. FIG. 3 depicts the second pocket 204 with an open zipper closure 206 and a pocket cover 308 situated inside of the second pocket 204. When not in use, the pocket cover 308 may be stowed in the second pocket 204, as illustrated in FIG. 3. The pocket cover 308 may be made of nylon, cloth, or any other suitable material.

Figure 4:
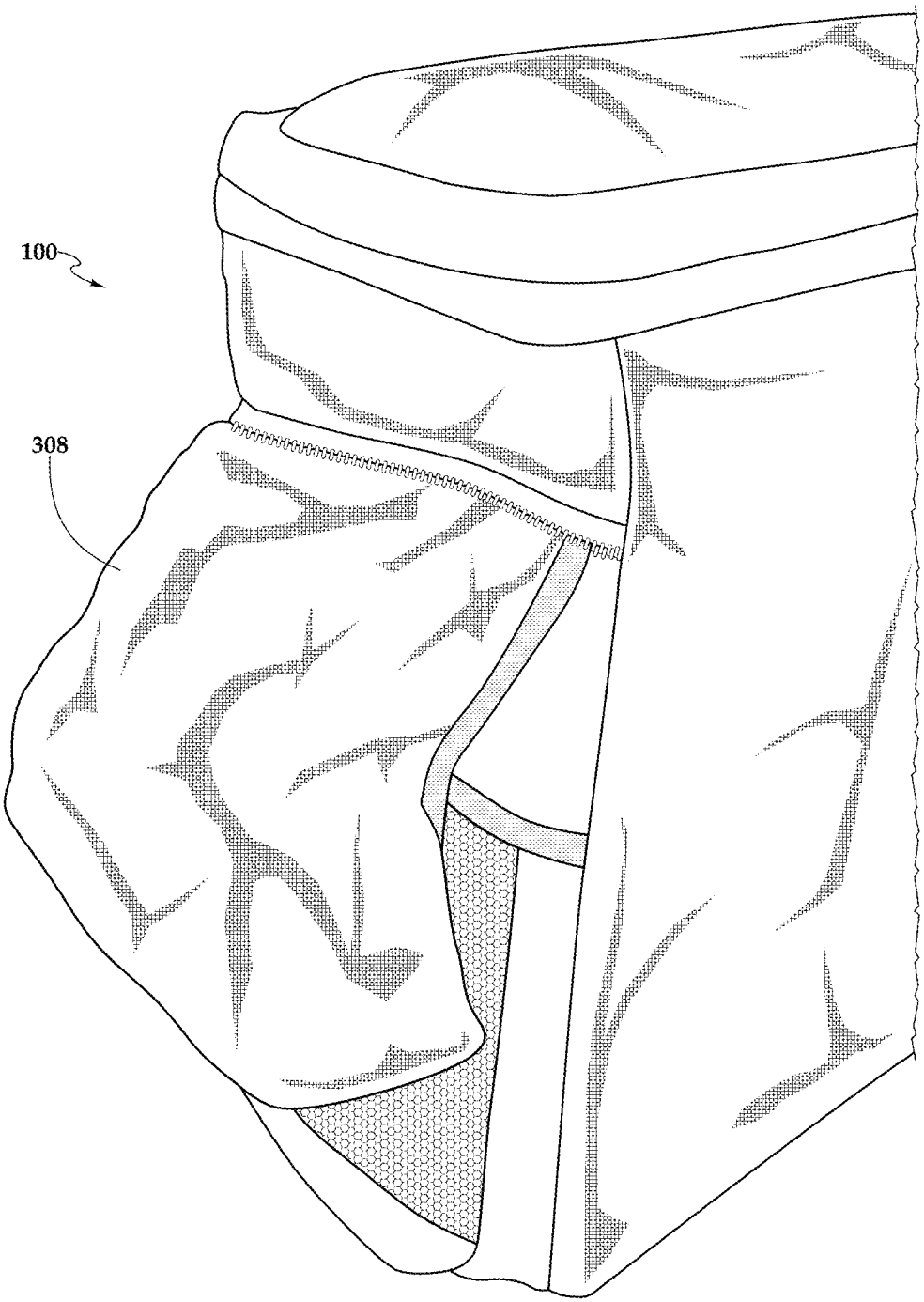
FIG. 4 depicts an example pocket cover being removed from the example external second pocket of FIG. 3, according to some embodiments.

FIG. 4 depicts an example pocket cover being removed from the example external second pocket of FIG. 3, according to some embodiments. FIG. 4 depicts the backpack 100, the second pocket 204, and the pocket cover 308 removed from the second pocket 204.

Figure 5:
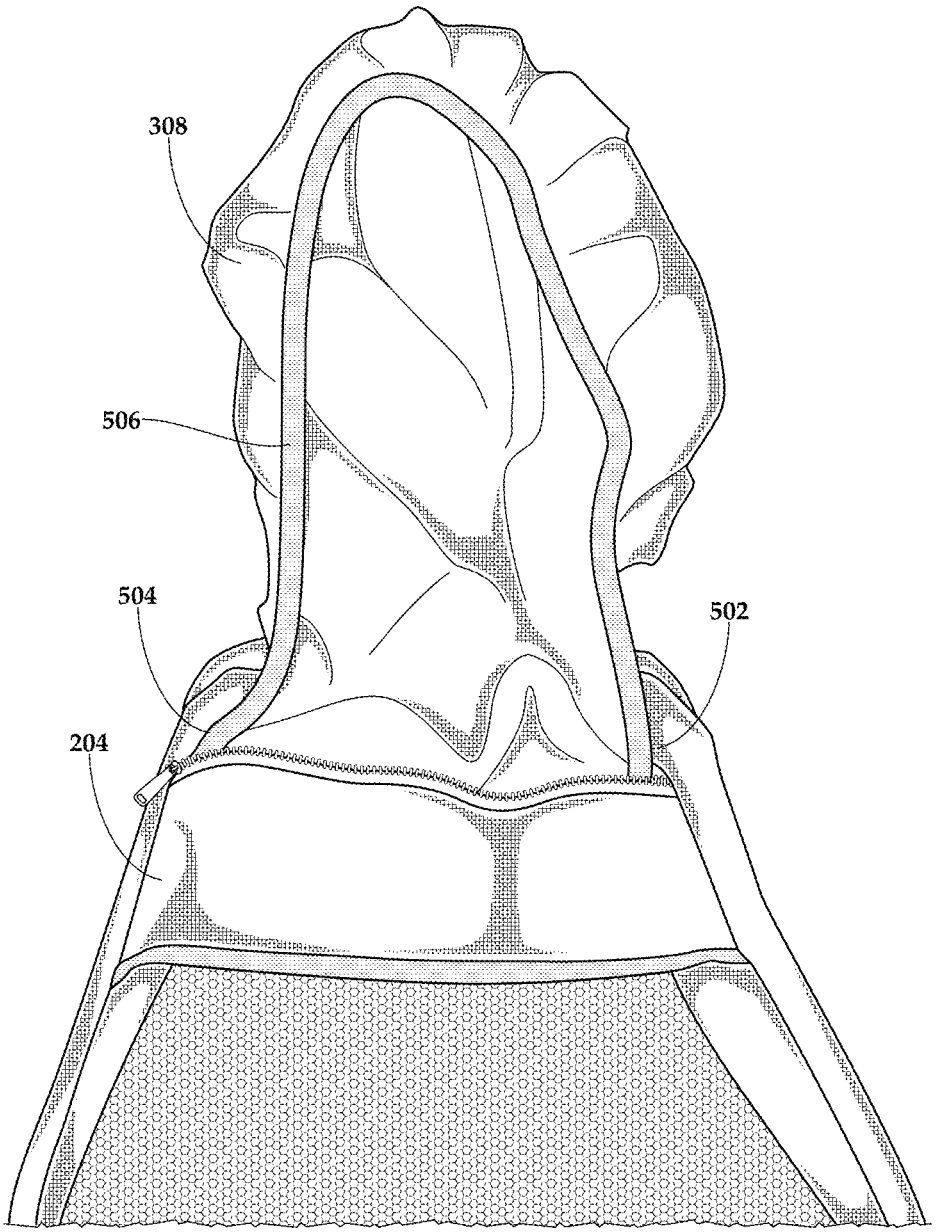
FIG. 5 depicts the underside of the example pocket cover of FIG. 4, according to some embodiments.

FIG. 5 depicts an underside view of the example pocket cover of FIG. 4, according to some embodiments. FIG. 5 depicts the underside of the pocket cover 308, which comprises an elastic band 506 attached to the inner sidewall of the second pocket 204 at a first attachment point 502 and a second attachment point 504.

Figure 6:
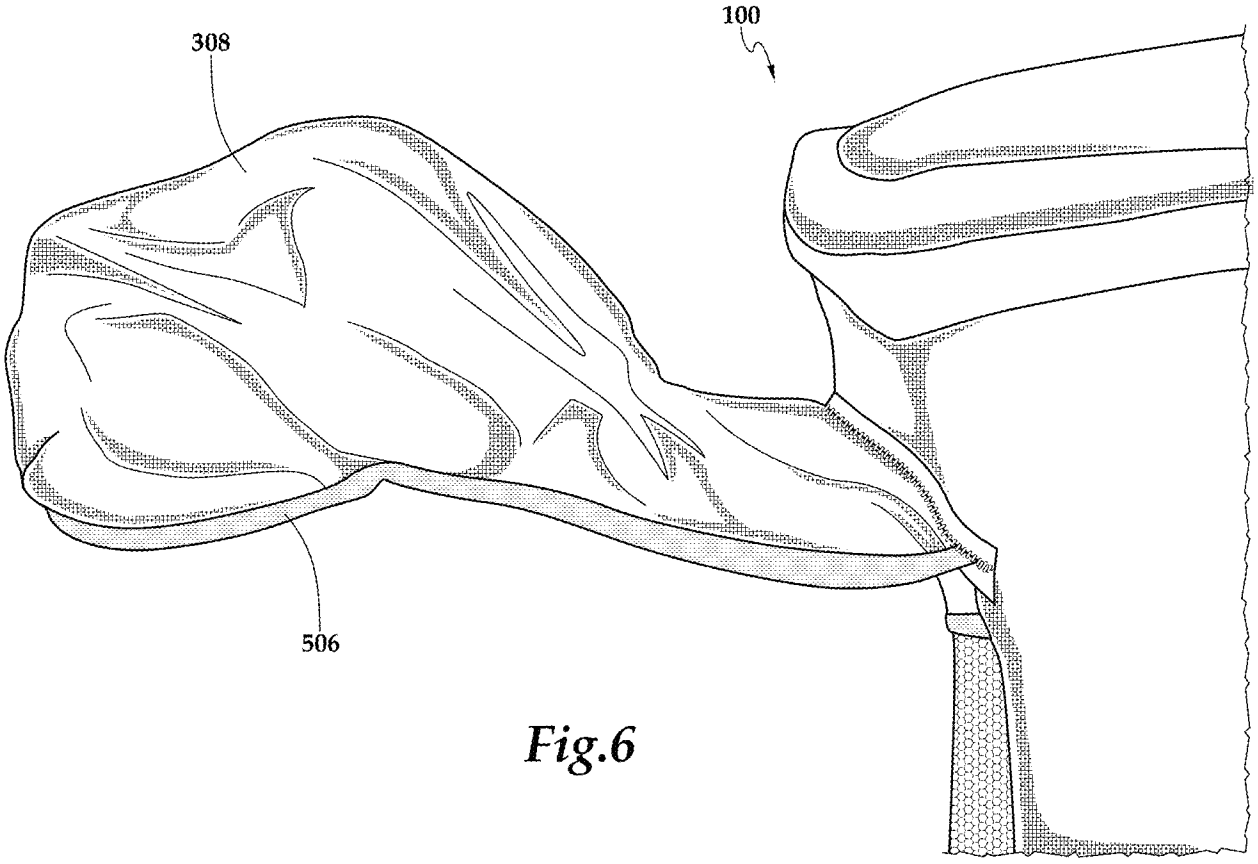
FIG. 6 depicts a side view of the example pocket cover of FIG. 4, according to some embodiments.

FIG. 6 depicts a side view of the example pocket cover of FIG. 4, according to some embodiments. FIG. 6 depicts the backpack 100, the pocket cover 308, and the elastic band 506. Although implementations may vary, as depicted here the pocket cover 308 has a vertically bisected lachrymiform (teardrop) shape, where the elastic band 506 lies along the bisecting plane. Thus, the distance between the bisecting plane and the pocket cover 308 is shorter where the pocket cover 308 attaches to the backpack 100 and further at the opposite end of the pocket cover 308. This particular shape allows the pocket cover 308 to fit over objects in the first pocket 202, which is lower on the backpack 100 than the point at which the pocket cover 308 attaches to the backpack 100.

The pocket cover 308 is depicted in FIG. 6 as extending horizontally from the backpack 100, but this is for illustration purposes only. In this example embodiment, the pocket cover 308 has no mechanism for extending and/or remaining in a horizontal position. However, some implementations may include mechanisms that allow the pocket cover 308 to extend and remain in a horizontal position.

Figure 7:
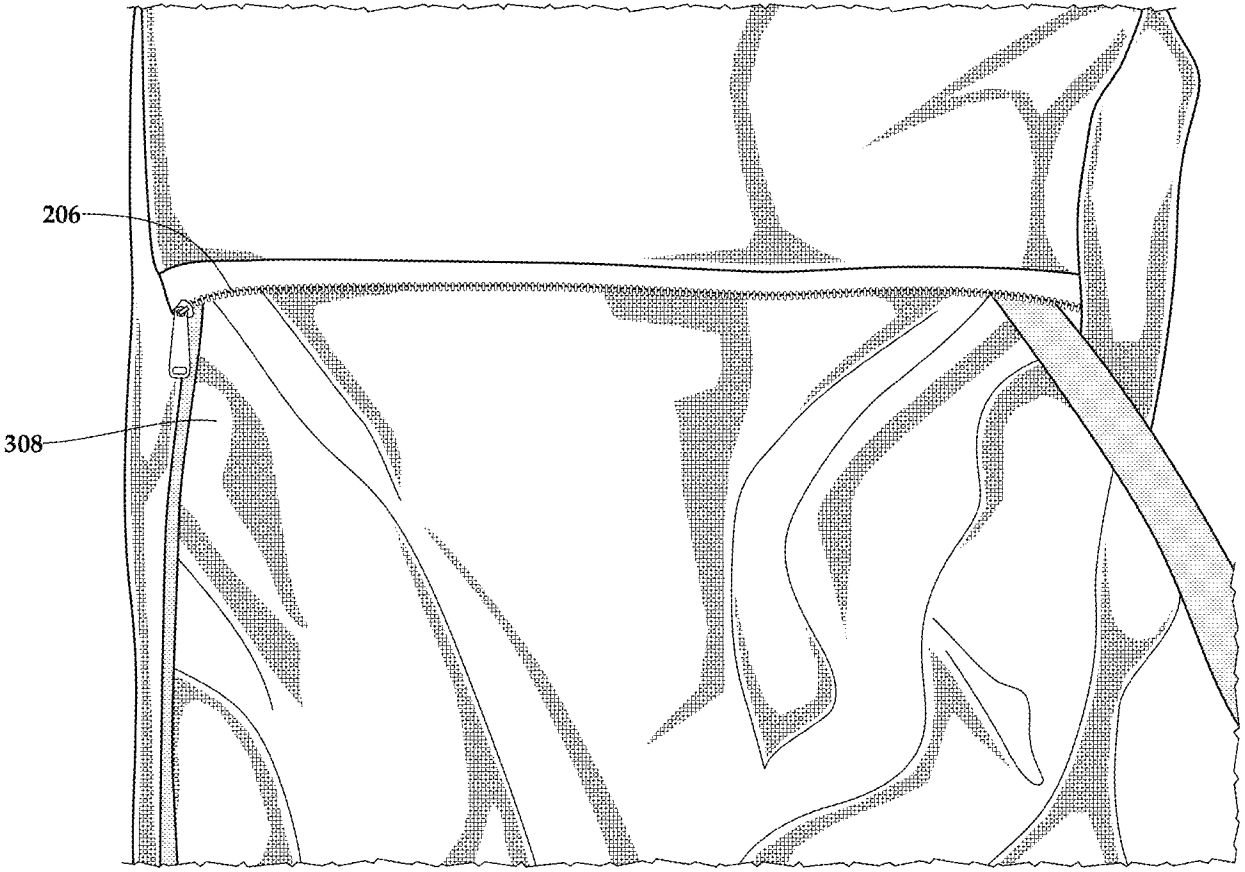
FIG. 7 depicts an example zipper for the second pocket and the relative positioning of the pocket cover, according to some embodiments.

FIG. 7 depicts an example zipper for the second pocket and the relative positioning of the pocket cover, according to some embodiments. FIG. 7 depicts the zipper 206 and the relative positioning of the pocket cover 308. In this example, the pocket cover 308 is attached to the inner sidewall of the second pocket 204, specifically under the upper half of the zipper 206.

Figure 8:
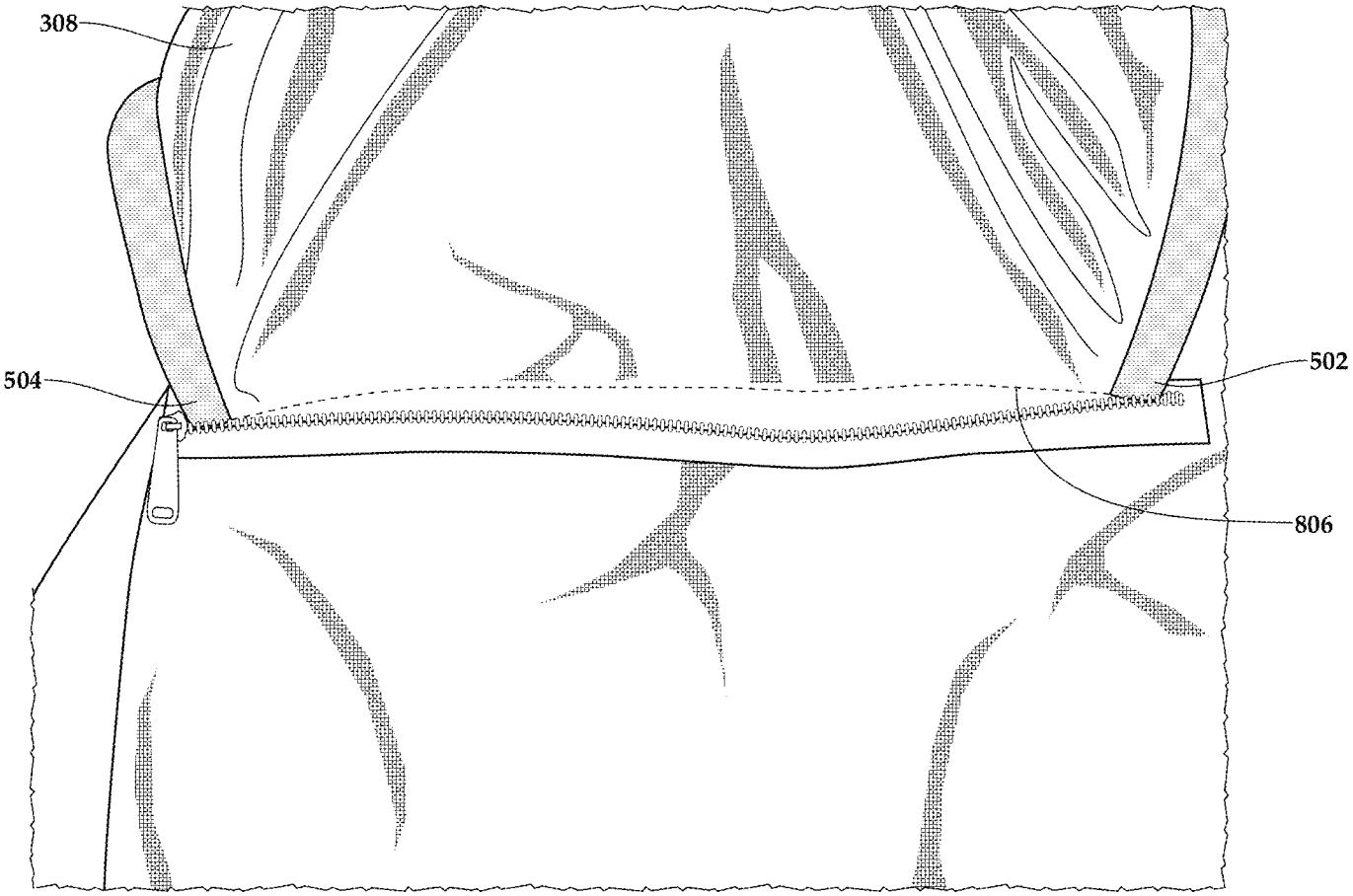
FIG. 8 depicts a close-up view of the lower half of the example zipper and the underside of the pocket cover of FIG. 7, according to some embodiments.

FIG. 8 depicts a close-up view of the lower half of the example zipper and the underside of the pocket cover of FIG. 7, according to some embodiments. FIG. 8 depicts the lower half of the zipper 206, the underside of the pocket cover 308, and a seam 806 at which the pocket cover 308 attaches. In addition, FIG. 8 depicts the attachment points for the elastic band: the first attachment point 502 and the second attachment point 504. In this example, the seam 806 is created by sewing the upper edge of the pocket cover 308 to the inner sidewall of the second pocket 204. However, the manner in which the pocket cover 308 is attached to the backpack 100 may vary. For example, the pocket cover 308 may also be glued, bonded, welded, etc. In general, the pocket cover 308 may be attached to the backpack 100 in any manner suitable for the functionality described herein and may vary depending on the materials chosen.

Figure 9:
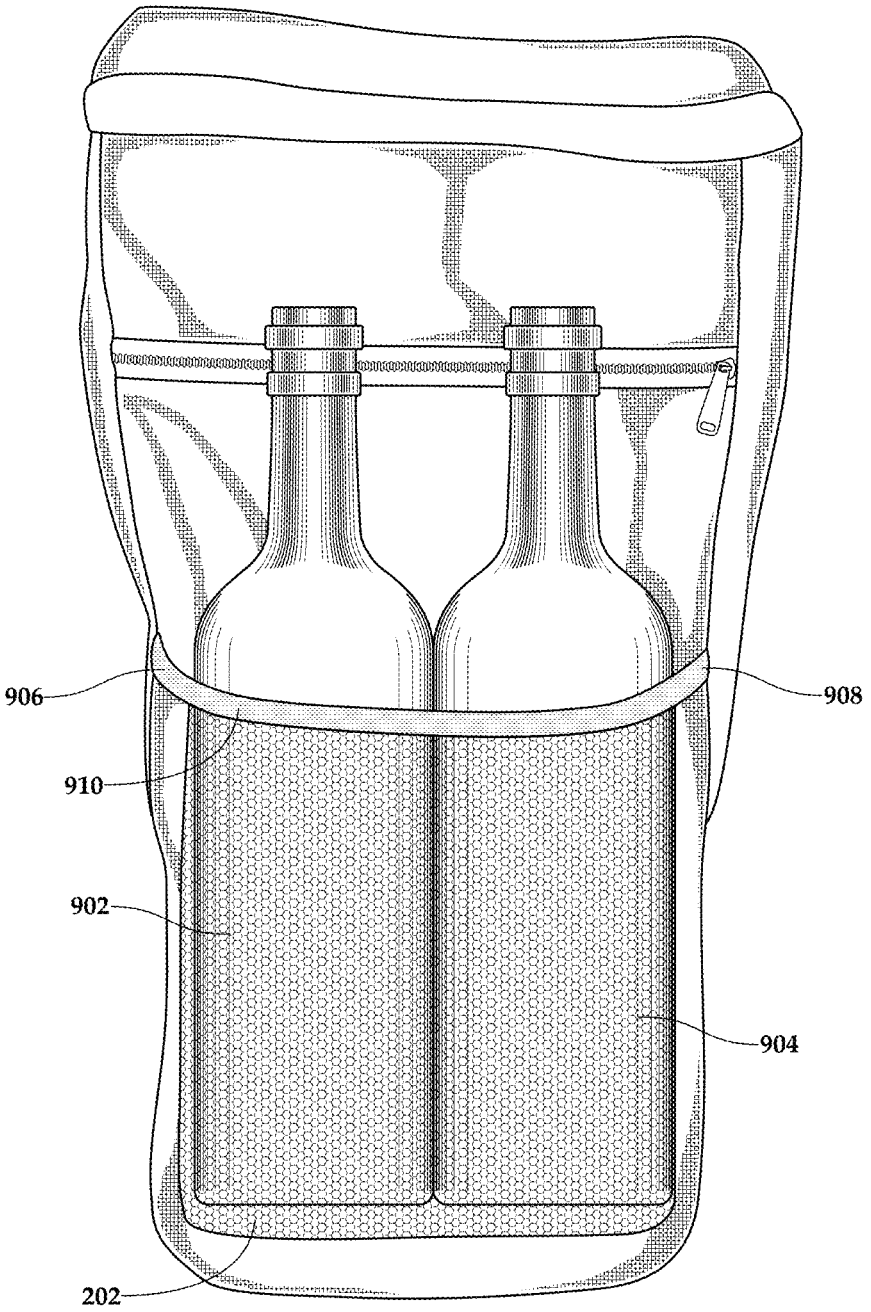
FIGS. 9-11 depict example operations of the pocket cover, according to some embodiments.
Figure 10:
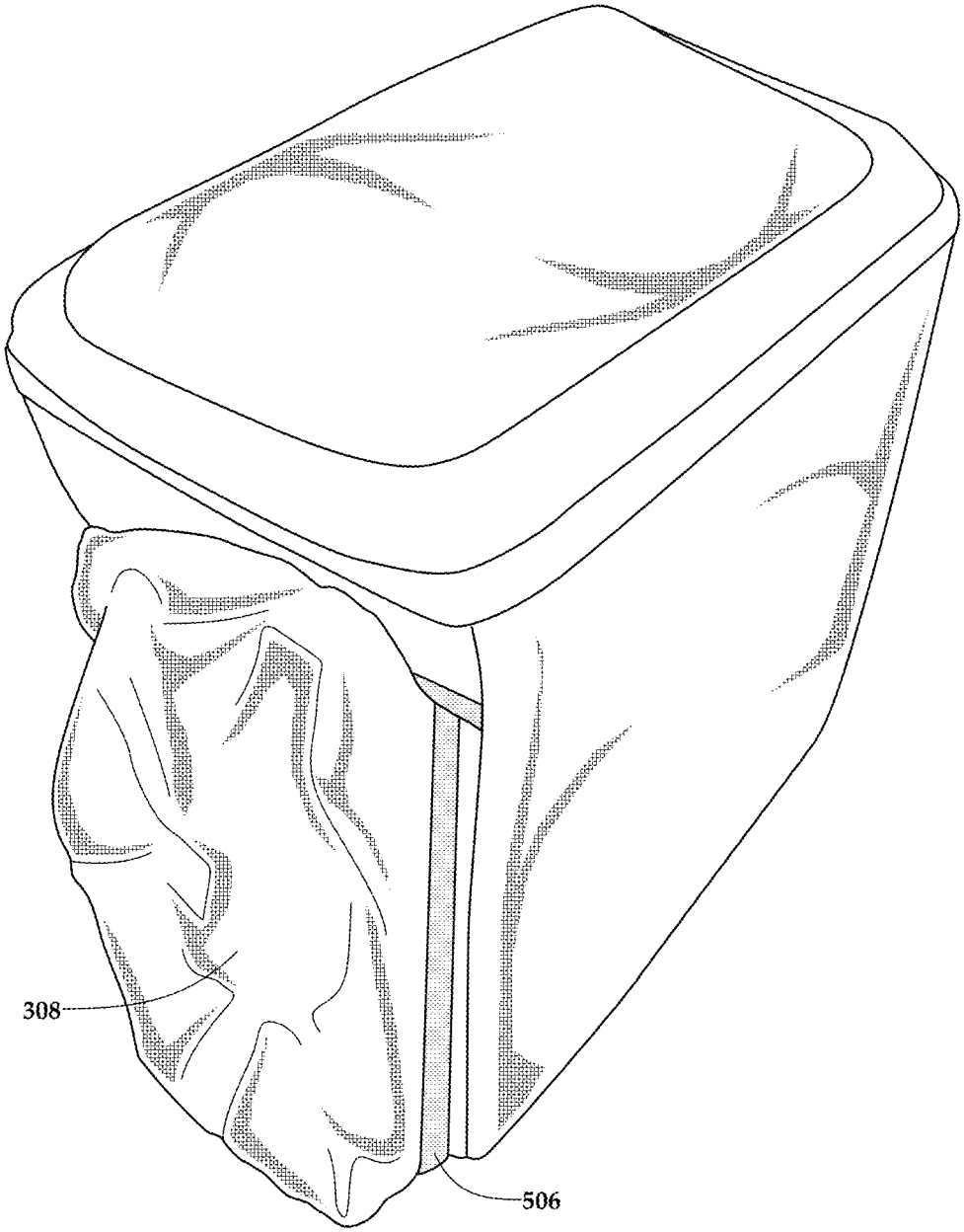
Figure 11:
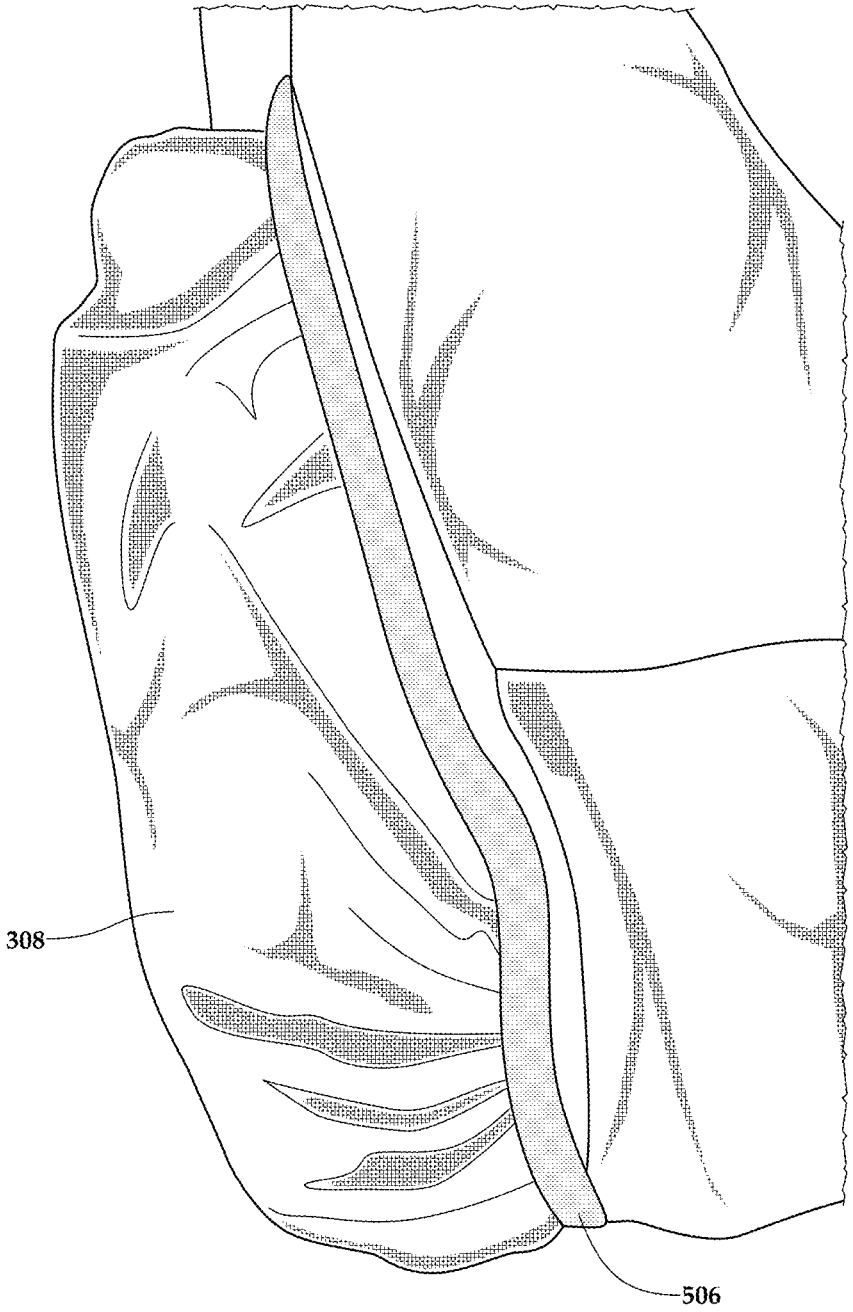

FIGS. 9-11 depict example operations of the pocket cover, according to some embodiments. Typically, a user will insert one or more items into the first pocket 202, remove the pocket cover 308 from the second pocket 204, and secure the pocket cover 308 over the first pocket 202 by positioning the elastic band 506 under the first pocket 202, as described in more detail below.

FIG. 9 depicts a first bottle 902 and a second bottle 904, inserted into the first pocket 202. An elastic strap 910 located at the top of the first pocket 202 and attached to the backpack 100 at a first attachment point 906 and a second attachment point 908 assists in securing the contents of the first pocket 202.

FIG. 10 depicts the pocket cover 308 after being removed from the second pocket 204 and secured around the first pocket 202 (and contents) using the elastic band 506. The length of the elastic band 506 is selected such that when the elastic band 506 is stretched around the first pocket 202, the elastic band 506 has sufficient tension to pull the pocket cover 308 against the bottom of objects in the first pocket 202. The force applied by the elastic band 506 to the object(s) in the first pocket 202 should be sufficient to generally prevent the pocket cover 308 from slipping, thereby hiding and/or securing the objects in the first pocket 202.

FIG. 11 depicts a portion of the bottom of the backpack 100 when the pocket cover 308 is deployed. In particular, FIG. 11 shows the elastic band 506 pulled tight against the bottom of the objects in the first pocket 202. Because the force imparted on the bottom of the first pocket 202 and contents thereof by the elastic band 506 causes friction, the elastic band 506 can hold the pocket cover 308 in place.

In some instances, different mechanisms for securing the pocket cover 308 over the first pocket 202 may be used in addition to or in place of the elastic band 506. For example, one half of a hook-and-loop fastener may be attached to the underside of the first pocket 202 or backpack 100 and the other half of the hook-and-loop fastener may be attached to the end of the pocket cover 308. The user may then use the hook-and-loop fastener to secure the pocket cover 308 in addition to or in place of the elastic band 506.

A buckle may be used in a similar manner, where one half of the buckle is attached to the underside of the first pocket 202 or backpack 100 and the other half of the buckle may be attached to the end of the pocket cover 308. The user may then connect the two halves of the buckle to secure the pocket cover 308 (in addition to or in place of the elastic band 506).

As another example, many types of hooks, latches, or other securing mechanism may be used. For example, buttons, snap mechanisms, and draw latches (e.g., hooking an elastic band around a receiver) may be used.

Although primarily discussed in the context of open, external pockets, embodiments of pocket covers are not so limited. For example, the user of a bag may wish to be able to open the bag without another person being able to see the contents of an internal pocket, and thus a pocket cover may be used to cover the internal pocket.

Although the description herein refers to a backpack, the inventive subject matter is applicable to any form of container or, even more broadly, any article of manufacture that may contain a pocket, such as a pair of shorts or other clothing.

Although described as using the elastic band 506 as a tensioning mechanism, the pocket cover 308 may use any tensioning mechanism consistent with the operations described herein, including, for example, a drawstring. Similarly, as described above, additional mechanisms may be used for securing the pocket cover 308 in conjunction with or in place of a tensioning mechanism, such as one or more buckles or hook-and-loop fasteners.

As noted above in relation to FIG. 6, some implementations may include a mechanism that allows the pocket cover 308 to remain in an extended, horizontal (or near horizontal) position. For example, the seam 806 where the pocket cover 308 attaches to the backpack 100 may comprise a mechanism similar to a spring hinge and the elastic band 506 may instead be replaced with an object that has sufficient stiffness to support the extended pocket cover, such as a wire. The spring hinge may then apply sufficient resistance or tension to the object that the pocket cover 308 remains in the horizontal, extended position until a sufficient external force is supplied (e.g., by a user) to cause the pocket cover 308 to rotate about the spring hinge.

Another possible mechanism that could be used to allow the pocket cover 308 to remain in an extended, horizontal (or near horizontal) position may include a wire or similar mechanism with sufficient stiffness to support the extended pocket cover, as described above, and one or more elastic bands or other tensioning mechanisms, wherein the elastic bands or other tensioning mechanism are attached to the backpack 100 above the seam 806 and attached to the wire or similar mechanism in such a way that the elastic bands or other tensioning mechanism apply a vertical force to the wire or similar mechanism, causing the pocket cover 308 to rotate vertically absent an external force.

Although two possible examples of mechanisms that would allow the pocket cover 308 to remain in an extended, horizontal (or near horizontal) position are described herein, the inventive subject matter is not so limited.

The description above describes the pocket cover 308 as attaching to the inner sidewall of the second pocket 204, specifically under the upper half of the zipper 206. However, implementations of the inventive subject matter are not so limited. For example, the pocket cover 308 may be attached to the inner sidewall of the second pocket 204, but under the lower half of the zipper 206. The pocket cover 308 may also be attached to the internal side of the outer sidewall of the second pocket 204, and may be specifically attached either below or above the zipper 206.

The pocket cover 308 may also be attached to the external side of the outer sidewall of the second pocket 204 below the zipper 206. In such a configuration, the pocket cover 308 might be stowed in the first pocket 202.

Further, in some implementations, the second pocket 204 may not include a zipper (e.g., it may simply be open), in which case the pocket cover 308 may be attached to the external side of the outer sidewall of the second pocket 204 or along the lip of the opening for the second pocket 204. In implementations in which the opening for the second pocket 204 still includes an upper and lower half, the second pocket 204 may be attached to the edge of either the upper half or lower half of the opening for the second pocket 204.

Further, in some implementations, the backpack 100 may not have a second pocket at all and the pocket cover 308 may be attached to the external side of the outer sidewall of the backpack 100. In such a configuration the pocket cover 308 might be stowed in the first pocket 202.

While the embodiments are described with reference to various implementations and exploitations, it will be understood that these embodiments are illustrative and that the scope of the inventive subject matter is not limited to them.

What is claimed is:

1. A container comprising:

a first pocket to store at least one item, the first pocket including a bottom side;

a second pocket having an outer sidewall that is an inner sidewall of the first pocket; and a pocket cover comprising a tensioning member attached at a first attachment point on the inner sidewall of the second pocket and a second attachment point on the inner sidewall of the second pocket, wherein the pocket cover is movable from a stowed position to a use position, wherein the pocket cover being in the stowed position comprises the pocket cover being stowed in the second pocket, and wherein the pocket cover being in the use position comprises the pocket cover extending out of the second pocket and over the first pocket with the tensioning member stretched about the bottom side of the first pocket.

2. The container of claim 1, wherein the pocket cover being in the use position further comprises the tensioning member stretching from the first attachment point along a first side of the first pocket and the tensioning member stretching from the second attachment point along a second side of the first pocket.

3. The container of claim 1, wherein the pocket cover being in the use position further comprises the tensioning member imparting force on the bottom side of the first pocket.

4. The container of claim 3, wherein the force imparted on the bottom side of the first pocket at least partially secures the pocket cover in the use position.

5. The container of claim 4, further comprising a secondary fastener, wherein a first portion of the secondary fastener is attached to the pocket cover and a second portion of the secondary fastener is attached to the container, wherein the first portion of the secondary fastener mates with the second portion of the secondary fastener to further secure the pocket cover in the use position.

6. The container of claim 3, wherein the first pocket contains one or more objects, wherein the force imparted on the bottom side of the first pocket and the one or more objects at least partially secures the pocket cover in the use position.

7. The container of claim 3, wherein the tensioning member is an elastic band.

8. A backpack comprising:

a main compartment that is defined by a front portion, a back portion, a top portion, a bottom portion, a right side portion, and a left side portion;

a first pocket having a bottom side and an inner sidewall, wherein the inner sidewall is part of an exterior of at least one of the right side portion and the left side portion of the main compartment of the backpack, wherein the first pocket is to store at least one item;

a second pocket having an outer sidewall that is the inner sidewall of the first pocket; and a pocket cover comprising a tensioning member attached at a first attachment point on the inner sidewall of the second pocket and a second attachment point on the inner sidewall of the second pocket, wherein the pocket cover is movable from a stowed position to a use position, wherein the pocket cover being in the stowed position comprises the pocket cover being stowed in the second pocket, and wherein the pocket cover being in the use position comprises the pocket cover extending out of the second pocket and over the first pocket with the tensioning member stretching around the bottom side of the first pocket.

9. The backpack of claim 8, wherein the pocket cover being in the use position further comprises the tensioning member stretching from the first attachment point along a first side of the first pocket and the tensioning member stretching from the second attachment point along a second side of the first pocket.

10. The backpack of claim 8, wherein the pocket cover being in the use position further comprises the tensioning member imparting force on the bottom side of the first pocket.

11. The backpack of claim 10, wherein the force imparted on the bottom side of the first pocket at least partially secures the pocket cover in the use position.

12. The backpack of claim 11, further comprising a secondary fastener, wherein a first portion of the secondary fastener is attached to the pocket cover and a second portion of the secondary fastener is attached to the backpack, wherein the first portion of the secondary fastener mates with the second portion of the secondary fastener to further secure the pocket cover in the use position.

13. The backpack of claim 10, wherein the first pocket contains one or more objects, wherein the force imparted on the bottom side of the first pocket and the one or more objects at least partially secures the pocket cover in the use position.

14. The backpack of claim 10, wherein the tensioning member is an elastic band.

15. A method comprising:

storing at least one item in a first pocket of a backpack, wherein the first pocket has an inner sidewall that is part of an exterior of the backpack and a bottom side;

removing a pocket cover stowed in a second pocket of the backpack, wherein the second pocket has an outer sidewall that is the inner sidewall of the first pocket; and covering the first pocket and the at least one item stored in the first pocket with the pocket cover, wherein the pocket cover comprises a tensioning member attached at a first attachment point on the inner sidewall of the second pocket and a second attachment point on the inner sidewall of the second pocket; and positioning the tensioning member around the first pocket and the at least one item such that the pocket cover is to be held in position while covering the first pocket and the at least one item stored in the first pocket by the tensioning member imparting force on the bottom side of the first pocket.

16. The method of claim 15, wherein the force imparted on the bottom side of the first pocket at least partially secures the pocket cover in place while covering the first pocket and the at least one item stored in the first pocket.

17. The method of claim 16, further comprising coupling a first portion of a secondary fastener to a second portion of the secondary fastener to further secure the pocket cover while covering the first pocket and the at least one item stored in the first pocket.

18. The method of claim 16, wherein the tensioning member is an elastic band.

19. The method of claim 15, wherein the force imparted on the bottom side of the first pocket and the at least one item in the first pocket at least partially secures the pocket cover while covering the first pocket and the at least one item stored in the first pocket.

20. The method of claim 15, wherein positioning the tensioning member around the first pocket comprises stretching the tensioning member from the first attachment point along a first side of the first pocket and stretching the tensioning member from the second attachment point along a second side of the first pocket.

* * * * *